US006390772B1

(12) United States Patent
Dziorny et al.

(10) Patent No.: US 6,390,772 B1
(45) Date of Patent: May 21, 2002

(54) AXIAL FLOW TURBINE AIR ECONOMIZER

(75) Inventors: Paul J. Dziorny, Mt. Airy; Roger S. O'Dell, Frederick; Jeff E. Hutchison, North Potomac, all of MD (US)

(73) Assignee: Fairchild Controls Corporation, Frederick, MD (US)

( * ) Notice: Subject to any disclaimer, the term of this patent is extended or adjusted under 35 U.S.C. 154(b) by 0 days.

(21) Appl. No.: 09/542,923

(22) Filed: Apr. 4, 2000

(51) Int. Cl.[7] ..... F01D 17/00

(52) U.S. Cl. ..... 415/147; 415/158; 415/28; 415/151; 415/202

(58) Field of Search ..... 415/147, 146, 415/156, 157, 158, 151, 167, 183, 202, 28; 60/602

(56) References Cited

U.S. PATENT DOCUMENTS 3,270,495 A * 9/1966 Connor ..... 60/602
3,557,549 A * 1/1971 Webster ..... 415/147
4,586,336 A * 5/1986 Hörler ..... 415/158
4,776,168 A * 10/1988 Woollenweber ..... 60/602
4,886,416 A * 12/1989 Wunderlich ..... 415/158
5,454,225 A * 10/1995 Sumser et al. ..... 60/602

* cited by examiner

*Primary Examiner*—F. Daniel Lopez
*Assistant Examiner*—Richard Woo
(74) *Attorney, Agent, or Firm*—Michael W. York

(57) ABSTRACT

Nozzle control apparatus for an axial flow air turbine having an inlet nozzle for air entering the turbine and an associated turbine inlet housing for channeling air flowing to the inlet nozzle for at least partially blocking air flow from the turbine inlet housing to the turbine inlet nozzle. The nozzle control apparatus uses an axially movable annular slider member that is biased to its open position by an annular spring and is moved axially by bleed air pressure exerted on a portion of the annular slider member.

9 Claims, 2 Drawing Sheets

AXIAL FLOW TURBINE AIR ECONOMIZER

BACKGROUND OF THE INVENTION

Axial flow air turbines can have various uses. One significant use is in an air drive unit incorporated in modern day wide-body aircraft such as the Boeing 747, 767 and 777 aircraft to augment engine driven hydraulic pumps during peak demand periods. The air drive unit also serves to provide hydraulic power during emergency conditions when one or more of the primary engine driven hydraulic pumps are inoperative. An air drive unit includes a turbine gearbox assembly, a modulating valve, a hydraulic pump, and other ancillary components such as a muffler, ducting, controller, and clamps. The turbine gearbox assembly contains the axial flow air turbine, inlet volute, nozzle, exhaust diffuser, gearbox assembly, and hydraulic pump interface.

In operation, engine bleed air flows through the inlet volute and turbine nozzle and drives the axial flow turbine. The turbine power generated by the engine bleed air is transmitted to the hydraulic pump interface through the gearbox. The gearbox allows the turbine to rotate at a much higher speed than the hydraulic pump, thus maximizing turbine efficiency without adversely effecting pump life. It is generally desirable to operate the turbine at nearly constant speed during all operational conditions. Since the engine bleed air pressure and hydraulic load vary during operation, a method for controlling the flow entering the turbine is required for stable, constant speed operation. Flow control currently is typically exerted in one of the following two ways:

1. Bleed air is metered by a modulating valve located upstream of the air turbine inlet volute. This system of control typically utilizes a fixed area nozzle to accelerate air into the axial flow turbine.
2. Bleed air is modulated by variable inlet guide vanes which serve as a variable geometry nozzle to accelerate air into the axial flow turbine. With this method the turbine speed is maintained constant by varying the nozzle area under varying power conditions.

The first system, utilizing a modulating valve, is far simpler than the second, utilizing variable inlet guide vanes. Only one moving part is typically utilized in an air modulating valve, whereas variable inlet guide vanes necessitate synchronized rotation of every nozzle vane. In addition to the actuating mechanism, each of the typically more than twenty nozzle vanes in a variable inlet guide vane system must contain suitable bearing surfaces, a timing gear, and precision shafts. Consequently initial cost of a system employing variable geometry is far greater than that of a system employing a modulating valve. In addition, the reliability of a variable inlet guide vane system is inherently lower than systems employing a modulating valve for turbine control due to the increased complexity and the increased number of parts.

The benefit of using a variable inlet guide vane system is reduced air consumption at normal operating conditions, especially at the sea level take-off condition. At this condition, maximum power must be delivered by the air drive unit to quickly retract the landing gear. At the same time, maximum engine thrust is required, and maximum engine bleed pressure is available. Since engine bleed air is taken directly from the engine compressor, which reduces the available engine thrust, it is desirable to minimize the bleed air consumption when maximum engine thrust is required.

The air drive unit can produce the required power at the sea level take-off condition by utilizing the high pressure supply air and using a small nozzle area to accelerate the flow into the turbine. This approach minimizes the required engine bleed flow rate, and is thus the most desirable in terms of engine performance. However, a primary role of air drive units is to provide power during emergency conditions. The emergency requirement that typically sizes the machine is a low pressure (typically 25%–50% of the sea level take-off pressure), high power condition. To produce high power at low pressure requires a large nozzle area and consequently high bleed air flow consumption.

Since the nozzle area in a variable inlet guide vane system can be controlled, the area is minimized for the sea level take-off condition to minimize bleed air consumption, and maximized for low pressure emergency conditions to produce the required power. Systems employing a modulating valve, however, normally use a fixed area nozzle. Since the low pressure emergency condition requires the largest nozzle area of all operational conditions, the fixed nozzle area in these systems is sized for this requirement. As a result, during the sea level take-off condition, and most operational conditions, systems employing a modulating valve for flow control have a much larger nozzle area than required. As a result, these systems consume more bleed air than similar variable inlet guide vane systems at the same condition (up to 40% more at the sea level take-off condition).

The inlet nozzle air control apparatus invention for an axial flow air turbine solves the problem of excessive air consumption in fixed nozzle systems without the added complexity and cost of a variable inlet guide vane system. Use of the inlet nozzle air control apparatus invention results in optimal flow consumption at two design points, as opposed to the single optimal design point of a fixed area nozzle, and performance equivalent to that of a variable inlet guide vane system at those design points, with far less complexity since only one additional moving part is required. The reduced complexity means improved reliability with equivalent performance. This invention can be successfully employed whenever optimal performance of an axial flow turbine is required at more than one operating condition.

The inlet nozzle air control apparatus invention offers automatic (self actuated) optimal nozzle area selection, with minimal complexity. This allows an axial flow turbine to operate optimally, thus reducing air flow consumption, at more than one design condition. This inlet nozzle air control apparatus invention allows multi point design optimization at a fraction of the cost of variable inlet guide vane systems, and with far greater reliability. Thus, simplicity and cost comparable to the fixed nozzle, modulating valve controlled system, and performance comparable to the complex variable inlet guide vanes controlled system is achieved using the inlet nozzle air control apparatus invention.

SUMMARY OF THE INVENTION

This invention relates to axial flow turbines and more particularly to axial flow turbines having increased flexibility.

Accordingly, it is an object of the invention to provide inlet nozzle air control apparatus for an axial flow turbine.

It is an object of the invention to provide inlet nozzle air control apparatus for an axial flow turbine that increases the flexibility of the axial flow turbine.

It is an object of the invention to provide inlet nozzle air control apparatus for an axial flow turbine that permits optimal performance of the axial flow turbine.

It is an object of the invention to provide inlet nozzle air control apparatus for an axial flow turbine that permits optimal performance of the axial flow turbine at more than one turbine operating condition.

It is an object of the invention to provide inlet nozzle air control apparatus for an axial flow turbine that permits optimal performance of the axial flow turbine at a plurality of turbine operating design points.

It is an object of the invention to provide inlet nozzle air control apparatus for an axial flow turbine that permits optimal performance of the axial flow turbine at at least two turbine operating design points.

It is an object of the invention to provide inlet nozzle air control apparatus for an axial flow turbine that reduces air consumption.

It is an object of the invention to provide inlet nozzle air control apparatus for an axial flow turbine that permits a reduced nozzle area.

It is an object of the invention to provide inlet nozzle air control apparatus for an axial flow turbine that is reliable.

It is an object of the invention to provide inlet nozzle air control apparatus for an axial flow turbine that has few parts.

It is an object of the invention to provide inlet nozzle air control apparatus for an axial flow turbine that has only one moving part.

It is an object of the invention to provide inlet nozzle air control apparatus for an axial flow turbine that is simple in its operation.

It is an object of the invention to provide inlet nozzle air control apparatus for an axial flow turbine that is easy to operate.

It is an object of the invention to provide inlet nozzle air control apparatus for an axial flow turbine that has reduced complexity.

It is an object of the invention to provide inlet nozzle air control apparatus for an axial flow turbine that has reduced weight.

It is an object of the invention to provide inlet nozzle air control apparatus for an axial flow turbine that has reduced maintenance.

It is an object of the invention to provide inlet nozzle air control apparatus for an axial flow turbine that is easy to manufacture.

It is an object of the invention to provide inlet nozzle air control apparatus for an axial flow turbine that has a low manufacturing cost.

These and other objects will be apparent from the invention that includes inlet nozzle air control apparatus for an axial flow air turbine having an inlet nozzle for air entering the turbine and an associated turbine inlet housing for channeling air to the inlet nozzle comprising means for at least partially blocking air flow from the turbine inlet housing to the turbine inlet nozzle and control means associated with the air flow blocking means for controlling the operation of the blocking means.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
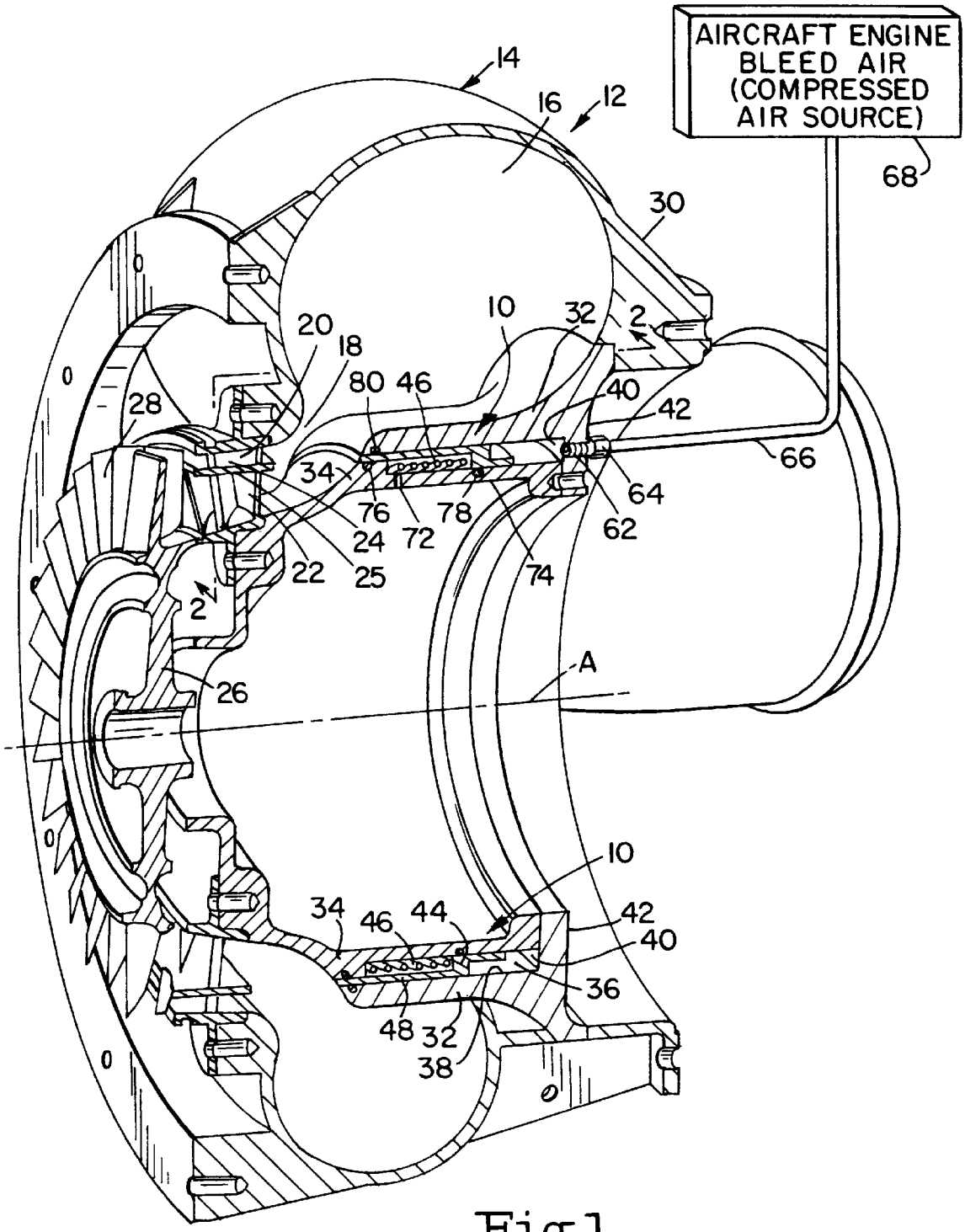
FIG. 1 is a perspective sectional view of a portion of an axial flow turbine with the inlet nozzle air control apparatus invention installed and in the non-blocking position.

Referring first to FIG. 1, the inlet air control apparatus invention is illustrated and is designated generally by the number 10. The inlet nozzle air control apparatus 10 is illustrated installed in a conventional axial flow air turbine that is designated generally by the number 12. It will be appreciated that a number of parts that would normally be part of the complete axial flow air turbine have been omitted from the figures that illustrate the axial flow turbine 12 for clarity and since they are not necessary for an understanding of the invention.

The air turbine 12, as illustrated, has an air turbine inlet housing 14 with a hollow curved tubular shaped interior 16 with an annular exit 18, an adjacent annular shaped turbine entrance nozzle 20 that has an inner annular entrance area 22 and an outer annular entrance area 24 that are separated by a circular ring 25 and an air turbine rotor 26 with its circumferentially located blades 28 that are located adjacent to the inlet nozzle 20. The air turbine inlet housing 14 has an outer portion 30 and inner portions 32 and 34. The portions 30, 32, and 34 are secured together in a conventional manner to form the air turbine inlet housing 14 with the interior 16.

The inner portion 34 has an outer circumferential recess 36. This recess 36 is partially closed by an inner cylindrical surface 38 on the inside of inner portion 32 and by the inner surface 40 on the outer end 42 of the inner portion 32. The circumferential recess 36 houses a generally ring shaped slider member 44 that is movable axially in the direction of the axis of rotation A of the rotor 26.

A circumferential spring 46 is located adjacent to the slider member 44 in position to normally bias the slider member 44 into its open position. The slider member 44 has a forward cylindrical closure portion 48 that is sized and shaped to slide axially back and forth within the cylindrical shaped slot 50 that exists between the inlet housing inner portions 32 and 34. This slot 50 is located directly adjacent to the annular exit portion 18 of the inlet housing 14 and also, as is apparent in FIG. 2, this slot 50 is located substantially opposite the inlet housing exit portion 18 from the circular separator ring 25 located in the annular entrance area 22 of the entrance nozzle 20.

Figure 2:
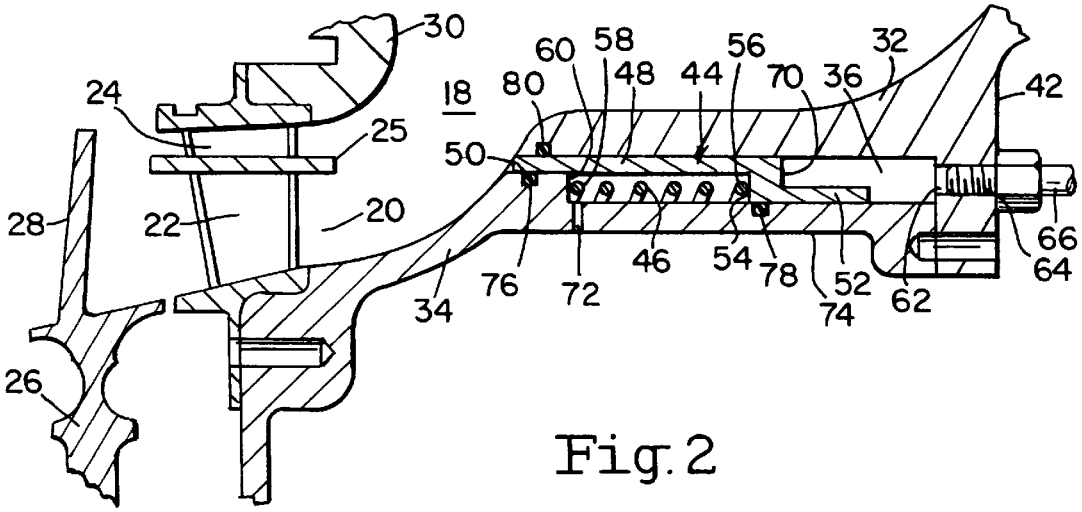
FIG. 2 is a view of a portion of the structure set forth in FIG. 1 taken in the direction 2—2 thereof.

In addition to the cylindrical closure portion 48, the slider member 44 also has an adjacently located cylindrical portion 52 that is smaller in diameter than the cylindrical closure portion 48. The inner end surface 54 provides a resting surface for one end 56 of the spring 46. The other end 58 of the spring 46 rests on the wall 60 of the recess 36 in the outer circumferential surface of the inlet housing portion 34. The fact that the end 58 of the spring 46 rests on the wall 60 and the other end rests on the surface 54 of the movable slider member 44 is the reason why the slider member 44 is biased by the spring 46 to its open or rearward position as illustrated in FIGS. 1 and 2.

A port 62 is provided in the outer end 42 of the inner portion 32 that is threaded to receive the hose fitting 64 that is in turn connected to the hose or conduit 66. This hose or conduit 66 is in turn connected to the source of compressed air 68 that in the preferred embodiment would be aircraft engine bleed air. This arrangement permits compressed air to pass from the source of compressed air 68 through the hose 66, through the fitting 64 that is secured in the port 62 and into the circumferential recess 36 where it exerts pressure on the cylindrical surface 70 of the slider member 44 that can overcome the spring force that is exerted by the end of the spring 56 on the cylindrical surface 54 of the slider member 44.

Figure 3:
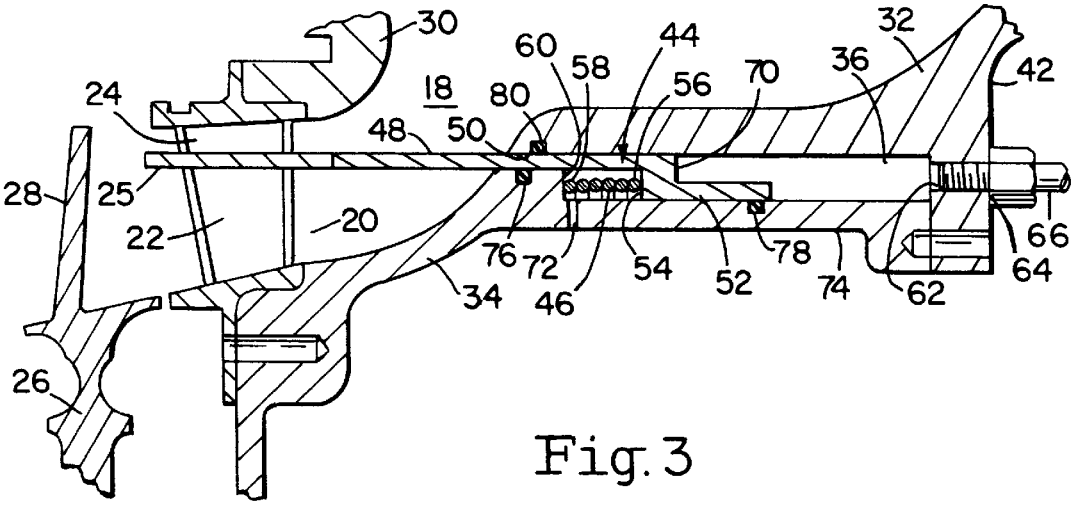
FIG. 3 is a view of the structure set forth in FIG. 2 with the inlet nozzle air control apparatus invention in the blocking position.

The force of compressed air on the cylindrical surface 70 of the slider member 44 can compress the spring 46 and cause the slider member 44 to have to move to the left so that its closure portion 48 passes through the slot 50 and into the annular exit portion 18 of the air turbine inlet housing 14 so that the closure portion 48 of the slider member 44 blocks air flow from the exit portion 18 of the inlet housing 14 into the inner annular entrance area 22 of the turbine entrance nozzle 20 as illustrated in FIG. 3. When the slider member 44 is in this position, it is clear that its closure portion 48 essentially only permits air to flow from the exit portion 88 of the air turbine inlet housing 14 into the outer entrance area 24 of the turbine entrance nozzle 20.

A vent 72 is provided from the recess 36 through inner portion 34 of the inlet housing 14 to its interior surface 74. This vent 72 vents the area of the recess 36 that is occupied by the spring 46 to the outside ambient air. It will also be apparent that a series of sealing rings are provided to be in contact with the slider member 44. In this connection, the inner portion 34 of the inlet housing 14 has circumferentially located seals 76 and 78 and the inner portion 32 of the inlet housing 14 has a sealing ring 80. The seals 76 and 80 are located to contact and seal the closure portion 48 of the slider member 44 and the other seal 78 is located in the cylindrical surface of the recess 36 in position to contact the slider member 44.

Figure 4:
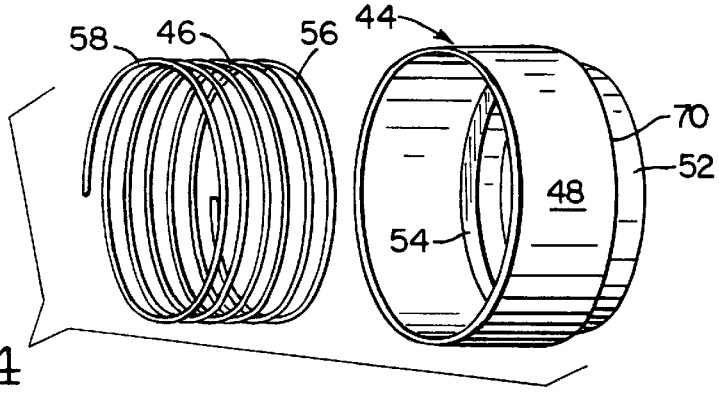
FIG. 4 is a perspective view of a portion of the structure set forth in FIGS. 1 through 3.

FIG. 4 illustrates in greater detail the previously described slider member 44 and the return spring 46 that are important parts of the air inlet control apparatus invention 10. As illustrated, the slider member 44 has the cylindrical closure portion 48 that is a hollow cylinder. The cylindrical closure portion 48 is also connected to an adjacently located larger diameter hollow cylinder 52 that is sized and shaped to be located around the circular return spring 46 with the end 58 of the spring 46 resting on the wall surface 60.

The inlet nozzle air control apparatus 10 is manufactured in the following manner. In order to manufacture the inlet nozzle air control apparatus 10, only relatively minor changes are necessary to the axial flow air turbine 12. Basically, the only changes are to the air turbine inlet housing 14. In this connection, the inner portion 34 of the inlet housing 14 is suitably cast and/or machined to provide the outer circumferential recess 36 and the inner portion 32 of the inlet housing 14 is suitably cast and machined to provide the surfaces 38 and 40 so that when these parts 32 and 34 are assembled they provide the closed recess 36 for the slider member 44 and the circular slot 50 for the cylindrical closure portion 48 of the slider member 44. The inner portions 32 and 34 of the air turbine inlet housing 14 are also suitably machined to accept the sealing rings 76, 78, and 80.

The slider member 44 is typically machined from aluminum using conventional machinery and techniques. The spring 46 is manufactured in a conventional manner from standered spring steel. The circular seals 71, 78 and 80 are conventional seal rings or piston rings. The assembly of the inlet nozzle air control apparatus 10 is accomplished during assembly of the turbine inlet housing 14. Prior to the inner portions 32 and 34 being installed the seals 76, 78 and 80 are installed and then when the portions 32 and 34 are installed the cylindrical slider member 44 and the cylindrical spray are installed in the recess 36. Also, the fitting 64 of the conduit 66 is threaded into the threaded hole 62 so that pressurized air can be supplied through the conduit 66 to move the slider member 44.

The air inlet control apparatus invention 10 is used in the following manner. As previously indicated, the air turbine inlet nozzle vanes 28 contain a cylindrical element 25 that separates the inlet nozzle flow area 20 into an outer flow area 24 and an inner flow area 22. The cylindrical slider member 44 which is incorporated in the adjacent portion of the inlet housing 14 is movable axially from the normally open position as illustrated in FIGS. 1 and 2 to the closed position as illustrated in FIG. 3. When the slider member 44 is in the open position, air flow passes through the both the inner and outer sections 22 and 24 of the turbine entrance nozzle 20. When the slider member 44 is in the closed position, flow can only pass through the outer section 24 of the entrance nozzle 20.

The slider member 44 is activated by the ambient to bleed air pressure differential since the vent 72 is exposed to ambient air and the port 62 is exposed to pressurized bleed air through the conduit 66. The slider member 44 is normally in the open position due to the force exerted by the spring 46 and hence the slider member 44 allows full air flow into the air turbine inlet nozzle 20 through both the inner and outer sections 22 and 24 of the nozzle 20. The slider member 44 is held in this position by the force of the return spring 46. The pressure differential at which the slider member 44 strokes is controlled by the spring 46 pre-load. Thus, when the pressure differential exceeds the set point pressure determined by the spring 46, the slider member 44 closes, and air flows only through the outer nozzle area 24. The outer nozzle area 24 is sized to produce the maximum required power when high bleed air pressure is available to minimize bleed air consumption. The pressure set point is chosen by selecting the appropriate spring 46 such, that all operational requirements are met.

Although the invention has been described in considerable detail with reference to a certain preferred embodiment, it will be understood that variations or modifications may be made within the spirit and scope of the invention as defined in the appended claims.

What is claimed is:

1. Inlet nozzle control apparatus for an axial flow air turbine with an air turbine rotor and blades having an axis of rotation and an annular shaped turbine entrance nozzle for air entering said axial flow air turbine having an annular entrance area with an inner annular entrance area and an outer annular entrance area separated by a circular shaped separator ring located around the axis of rotation of said air turbine rotor and blades and being axially displaced on said axis of rotation of said air turbine rotor and blades from said air turbine rotor and blades with the outer annular entrance area being located further from the axis of rotation of said air turbine rotor and blades than the inner annular entrance area comprising: an air turbine inlet housing with a hollow interior with an annular exit portion located adjacent to said annular shaped turbine entrance nozzle, said air turbine inlet housing having a cylindrical shaped slot located adjacent to said annular exit portion of said air turbine inlet housing substantially opposite from said circular shaped separator ring located in said annular entrance area of said turbine entrance nozzle, a generally ring shaped axially movable slider member located in said cylindrical shaped slot located to be movable axially in the direction of the axis of rotation of said air turbine rotor and blades between an open position and a closed position, said slider member having a cylindrical closure portion sized and shaped to slide axially within said cylindrical shaped slot to block air flow from said annular exit portion of said air turbine inlet housing into said inner annular entrance area of said turbine entrance nozzle and only permit air to flow from said annular exit portion of said air turbine inlet housing into said outer entrance area of said turbine entrance nozzle when said closure portion is in said closed position, slider member biasing means located in said turbine inlet housing in position for normally exerting a force on said slider member, a source of compressed air and a conduit connected to said a source of compressed air and to said air turbine inlet housing for permitting compressed air to pass from the source of compressed air through said conduit to said air turbine inlet housing to exert pressure on said slider member to overcome the force exerted by said slider member biasing means on said slider member.

2. The inlet nozzle control apparatus for an axial flow air turbine of claim 1 wherein said source of compressed air comprises aircraft engine bleed air.

3. The inlet nozzle control apparatus for an axial flow air turbine of claim 1 wherein said slider member biasing means is located to bias said slider into said open position.

4. The inlet nozzle control apparatus for an axial flow air turbine of claim 1 wherein said slider member biasing means comprises a spring.

5. The inlet nozzle control apparatus for an axial flow air turbine of claim 4 wherein said spring comprises a circumferential spring.

6. The inlet nozzle control apparatus for an axial flow air turbine of claim 5 wherein said slider member has a cylindrical portion located adjacent to said cylindrical closure portion with a smaller diameter than the diameter of said cylindrical closure portion with the surface between the cylindrical portions located to provide a surface to be exposed to compressed air from said source of compressed air.

7. The inlet nozzle control apparatus for an axial flow air turbine of claim 6 wherein said air turbine inlet housing comprises a plurality of secured together portions and one portion has a circumferential recess forming a portion of the cylindrical shaped slot located in said air turbine inlet housing.

8. The inlet nozzle control apparatus for an axial flow air turbine of claim 1 further comprising a vent located in said air turbine inlet housing.

9. The inlet nozzle control apparatus for an axial flow air turbine of claim 1 further comprising a plurality of sealing rings located in said air turbine inlet housing in position to contact said slider member.

* * * * *